US005414503A

United States Patent [19]

Siegel et al.

[11] Patent Number: 5,414,503

[45] Date of Patent: May 9, 1995

[54] PREDICTIVE DECURLER APPARATUS AND METHOD

[75] Inventors: Robert P. Siegel; Youti Kuo, both of Penfield; Edward C. Hanzlik, Fairport, all of N.Y.

[73] Assignee: Xerox Corporation, Stamford, Conn.

[21] Appl. No.: 166,371

[22] Filed: Dec. 13, 1993

[51] Int. Cl.[6] ..... G03G 21/00

[52] U.S. Cl. ..... 355/309; 162/197; 162/271; 271/188; 271/209

[58] Field of Search ..... 355/282, 285, 290, 309, 355/311; 162/197, 270, 271; 271/161, 188, 209

[56] References Cited

U.S. PATENT DOCUMENTS

| | | | |
|---|---|---|---|
| 4,926,358 | 5/1990 | Tani | 364/562 |
| 4,977,432 | 12/1990 | Coombs et al. | 355/309 |
| 5,084,731 | 1/1992 | Baruch | 355/208 |
| 5,144,385 | 9/1992 | Tani | 355/309 |
| 5,201,514 | 4/1993 | Rebres | 271/188 |
| 5,287,157 | 2/1994 | Miyazato et al. | 355/309 |

*Primary Examiner*—A. T. Grimley
*Assistant Examiner*—William J. Royer
*Attorney, Agent, or Firm*—Kevin R. Kepner

[57] ABSTRACT

An apparatus for adaptive sheet decurling in an electrophotographic printing machine. A plurality of sensors are provided to determine the basis weight of the copy sheet, the density of the image being transferred to the copy sheet and fused thereon, the relative humidity of the machine environment, the process speed of the print engine, and any other relevant parameters. Signals indicative of these parameters are generated and sent to the machine controller which processes these signals and predicts the degree and direction of curl expected in a sheet. Based on the degree of and direction of curl, a bidirectional variable penetration decurler is actuated to a setting which should provide the proper amount of mechanical decurling force.

9 Claims, 6 Drawing Sheets

PREDICTIVE DECURLER APPARATUS AND METHOD

This invention relates generally to a method and system for decurling a sheet, and more particularly concerns a predictive apparatus and method to minimize sheet curl.

In a typical electrophotographic printing process, a photoconductive member is charged to a substantially uniform potential so as to sensitize the surface thereof. The charged portion of the photoconductive member is exposed to selectively dissipate the charges thereon in the irradiated areas. This records an electrostatic latent image on the photoconductive member. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

A curl or bend may be created in a sheet as a result of its method of manufacture. In addition, a problem which sometimes occurs in a printing machine such as an electrophotographic printing machine is the development of a curl or bend in the sheet as the sheet passes through the various processing stations of the printing machine.

A curled sheet may be undesirable from a variety of standpoints. For instance, the curled sheet may be difficult to handle as the sheet is processed in a printing machine. Curled sheets may tend to produce jams or misfeeds within the printing machine. Additionally, sheets having a curl or bend therein may be esthetically undesirable to consumers thereof.

Accordingly, some printing machines utilize mechanical decurlers which bend the fused sheet around a roll or mandrel to mechanically induce a bend in the opposite direction of the sheet curl to eliminate or minimize the curl. Most of the mechanical decurlers utilize a fixed bend radius or a fixed radius and a bypass path through which sheets are passed depending on the degree of curl. It is also possible to vary the bend on the sheet to decurl it based upon the amount of image data on the sheet.

It is desirable to provide a system that can predict the degree and direction of curl that is likely based on parameters such as toner density, sheet weight, fusing speed, relative humidity of the fusing area, etc. and adjust the force and direction of the decurler accordingly.

The following disclosures may be relevant to various aspects of the present invention:

U.S. Pat. No. 5,084,731 Patentee: Baruch Issue Date: Jan. 28, 1992

U.S. Pat. No. 4,977,432 Patentee: Coombs et al. Issued: Dec. 11, 1990

U.S. Pat. No. 4,926,358 Patentee: Tani et al. Issue Date: May 15, 1990

U.S. Ser. No. 08/032,716 Inventor: Resto et al. Filing Date: Mar. 17, 1993

U.S. Ser. No. 08/032,717 Inventor: Resto et al. Filing Date: Mar. 17, 1993

The relevant portions of the foregoing disclosures may be briefly summarized as follows:

U.S. Pat. No. 5,084,731 discloses a multiple nip decurler that varies the direction and amount of force applied to a sheet based upon image data.

U.S. Pat. No. 4,977,432 discloses a device which is disposed in the path of paper leaving a printing unit or processor such as an office copier, facsimile or non-impact printer and has an arcuate concave guide and a feed roll which causes the paper to pass between the guide and the feed roll to decurl the paper.

U.S. Pat. No. 4,926,358 describes a decurling system that measures the direction and size of a sheet curl and then varies the curling force and direction accordingly.

U.S. Ser. No. 08/032,716 describes a system for decurling a sheet with a toner image fused thereon which includes a mechanism for reducing the temperature of the toner image from a first temperature to a second temperature, the second temperature being less than the glass transition temperature of the toner material. The system further includes a mechanical decurler to apply a force to the sheet and the toner after the temperature of the toner has been reduced.

U.S. Ser. No. 08/032,717 describes a system for decurling a sheet with a toner image fused thereon which includes a mechanism for generating a flow of room ambient air and directing the flow of room ambient air onto the sheet. The decurling system includes a decurler adapted to apply mechanical force to the sheet after the flow of room ambient air has been directed onto the sheet by the directing mechanism.

In accordance with one aspect of the present invention, there is provided a printing machine in which an image is fixed to a sheet, wherein the improvement comprises means for determining at least one of a plurality of parameters of the sheet and generating a signal indicative thereof and an adjustable decurling device. A controller, responsive to the signal from said determining means, for adjusting said decurling device is also provided.

Pursuant to another aspect of the present invention, there is provided a method for predicting the amount of curl in a sheet and applying a variable decurling force in a printing machine comprising the steps of determining at least one of a plurality of parameters effecting decurling a sheet and generating a parameter signal indicative thereof and adjusting, in response to the parameter signal, the decurling force being applied to the sheet by a sheet decurler.

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 4:
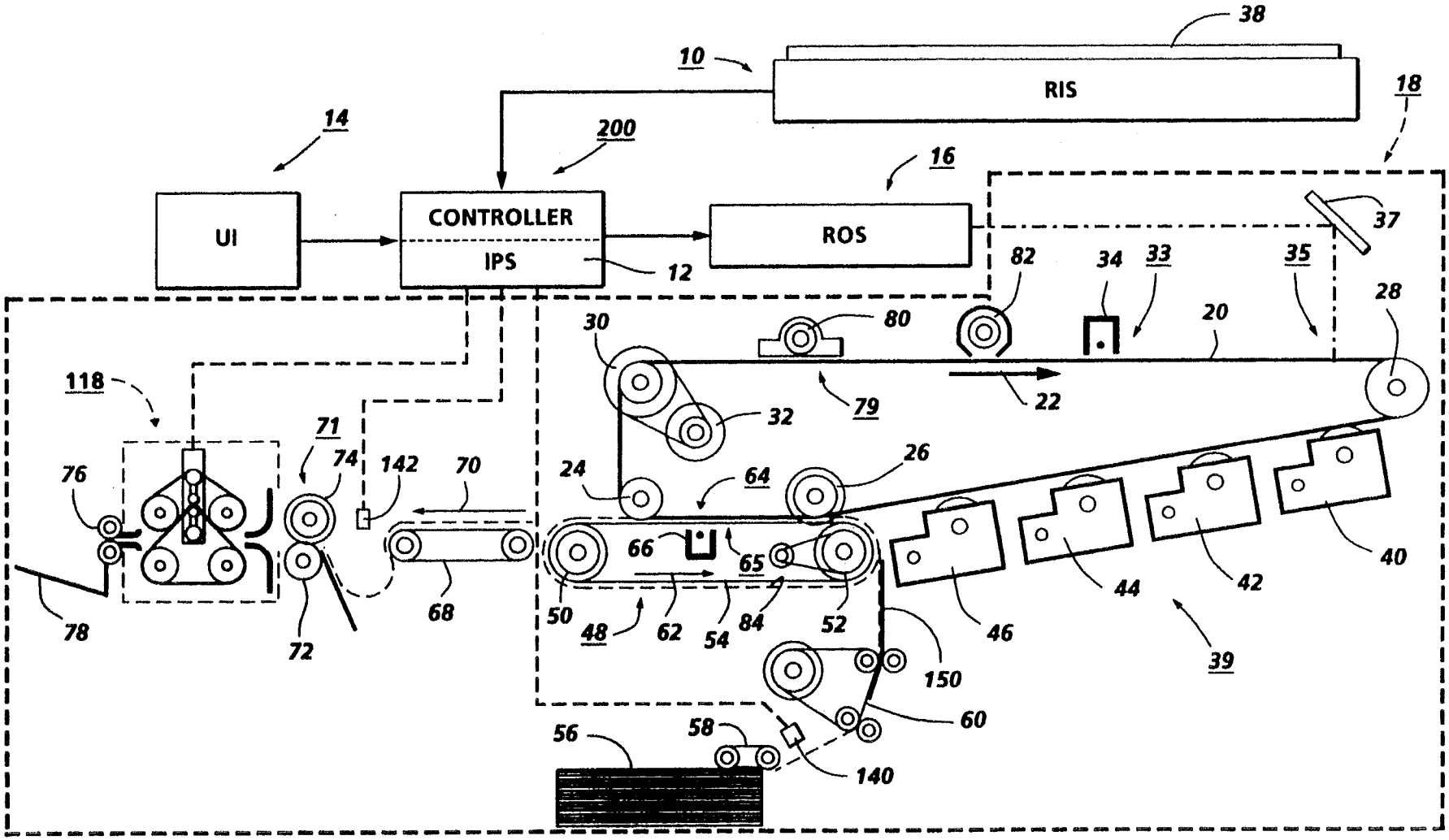
FIG. 4 is a schematic view of a full color electrophotographic printing machine incorporating the decurler assembly of FIG. 1.

For a general understanding of the features of the present invention, reference is made to the drawings. In the drawings, like references have been used throughout to designate identical elements. FIG. 4 is a schematic elevational view of an illustrative electrophotographic machine incorporating the features of the present invention therein. It will become evident from the following discussion that the present invention is equally well suited for use in a wide variety of printing systems, and is not necessarily limited in its application to the particular system shown herein.

Turning initially to FIG. 4, during operation of the printing system, a multi-color original document 38 is positioned on a raster input scanner (RIS) indicated generally by the reference numeral 10. The RIS contains document illumination lamps, optics, a mechanical scanning drive, and a charge coupled device (CCD array). The RIS captures the entire original document and converts it to a series of raster scan lines and measures a set of primary color densities, i.e. red, green and blue densities, at each point of the original document. This information is transmitted to controller 200 which includes an image processing system (IPS), indicated generally by the reference numeral 12. IPS 12 contains control electronics which prepare and manage the image data flow to a raster output scanner (ROS), indicated generally by the reference numeral 16. A user interface (UI), indicated generally by the reference numeral 14, is in communication with IPS 12. UI 14 enables an operator to control the various operator adjustable functions. The output signal from UI 14 is transmitted to IPS 12. A signal corresponding to the desired image is transmitted from IPS 12 to ROS 16, which creates the output copy image. ROS 16 lays out the image in a series of horizontal scan lines with each line having a specified number of pixels per inch. ROS 16 includes a laser having a rotating polygon mirror block associated therewith. ROS 16 exposes a charged photoconductive belt 20 of a printer or marking engine, indicated generally by the reference numeral 18, to achieve a set of subtractive primary latent images. The latent images are developed with cyan, magenta, and yellow developer material, respectively. These developed images are transferred to a copy sheet in superimposed registration with one another to form a multi-colored image on the copy sheet. This multi-colored image is then fused to the copy sheet forming a color copy.

With continued reference to FIG. 4, printer or marking engine 18 is an electrophotographic printing machine. Photoconductive belt 20 of marking engine 18 is preferably made from a polychromatic photoconductive material. The photoconductive belt moves in the direction of arrow 22 to advance successive portions of the photoconductive surface sequentially through the various processing stations disposed about the path of movement thereof. Photoconductive belt 20 is entrained about transfer rollers 24 and 26, tensioning roller 28, and drive roller 30. Drive roller 30 is rotated by a motor 32 coupled thereto by suitable means such as a belt drive. As roller 30 rotates, it advances belt 20 in the direction of arrow 22.

Initially, a portion of photoconductive belt 20 passes through a charging station, indicated generally by the reference numeral 33. At charging station 33, a corona generating device 34 charges photoconductive belt 20 to a relatively high, substantially uniform electrostatic potential.

Next, the charged photoconductive surface is moved through an exposure station, indicated generally by the reference numeral 35. Exposure station 35 receives a modulated light beam corresponding to information derived by RIS 10 having a multi-colored original document 38 positioned thereat. RIS 10 captures the entire image from the original document 38 and converts it to a series of raster scan lines which are transmitted as electrical signals to IPS 12. The electrical signals from RIS 10 correspond to the red, green and blue densities at each point in the original document. IPS 12 converts the set of red, green and blue density signals, i.e. the set of signals corresponding to the primary color densities of original document 38, to a set of colorimetric coordinates. The operator actuates the appropriate keys of UI 14 to adjust the parameters of the copy. UI 14 may be a touch screen, or any other suitable control panel, providing an operator interface with the system. The output signals from UI 14 are transmitted to IPS 12. The IPS then transmits signals corresponding to the desired image to ROS 16. ROS 16 includes a laser with rotating polygon mirror blocks. Preferably, a nine facet polygon is used. ROS 16 illuminates, via mirror 37, the charged portion of photoconductive belt 20 at a rate of about 400 pixels per inch. The ROS will expose the photoconductive belt to record three latent images. One latent image is developed with cyan developer material. Another latent image is developed with magenta developer material and the third latent image is developed with yellow developer material. The latent images formed by ROS 16 on the photoconductive belt correspond to the signals transmitted from IPS 12. A fourth latent image can also be recorded to be developed with black toner.

After the electrostatic latent images have been recorded on photoconductive belt 20, the belt advances such latent images to a development station, indicated generally by the reference numeral 39. The development station includes four individual developer units indicated by reference numerals 40, 42, 44 and 46. The developer units are of a type generally referred to in the art as "magnetic brush development units." Typically, a magnetic brush development system employs a magnetizable developer material including magnetic carrier granules having toner particles adhering triboelectrically thereto. The developer material is continually brought through a directional flux field to form a brush of developer material. The developer material is constantly moving so as to continually provide the brush with fresh developer material. Development is achieved by bringing the brush of developer material into contact with the photoconductive surface. Developer units 40, 42, and 44, respectively, apply toner particles of a specific color which corresponds to the compliment of the specific color separated electrostatic latent image recorded on the photoconductive surface. The color of each of the toner particles is adapted to absorb light within a preselected spectral region of the electromagnetic wave spectrum. For example, an electrostatic latent image formed by discharging the portions of charge on the photoconductive belt corresponding to the green regions of the original document will record the red and blue portions as areas of relatively high charge density on photoconductive belt 20, while the green areas will be reduced to a voltage level ineffective or development. The charged areas are then made visible by having developer unit 40 apply green absorbing (magenta) toner particles onto the electrostatic latent image recorded on photoconductive belt 20. Similarly, a blue separation is developed by developer unit 42 with blue absorbing (yellow) toner particles, while the red separation is developed by developer unit 44 with red absorbing (cyan) toner particles. Developer unit 46 contains black toner particles and may be used to develop the electrostatic latent image formed from a black and white original document and or to provide under-color removal in a color image. Each of the developer units is moved into and out of an operative position. In the operative position, the magnetic brush is closely adjacent the photoconductive belt, while in the non-operative position, the magnetic brush is spaced therefrom. In FIG. 4, developer unit 40 is shown in the operative position with developer units 42, 44 and 46 being in the non-operative position. During development of each electrostatic latent image, only one developer unit is in the operative position, the remaining developer units are in the non-operative position. This insures that each electrostatic latent image is developed with toner particles of the appropriate color without commingling.

After development, the toner image is moved to a transfer station, indicated generally by the reference numeral 65. Transfer station 65 includes a transfer zone, generally indicated by reference numeral 64. In transfer zone 64, the toner image is transferred to a sheet of support material, such as plain paper amongst others. At transfer station 65, a sheet transport apparatus, indicated generally by the reference numeral 48, moves the sheet into contact with photoconductive belt 20. Sheet transport 48 has a pair of spaced belts 54 entrained about a pair of substantially cylindrical rollers 50 and 52. A sheet gripper (not shown) extends between belts 54 and moves in unison therewith. A sheet 150 is advanced from a stack of sheets 56 disposed on a tray. A friction retard feeder 58 advances the uppermost sheet from stack 56 onto a pre-transfer transport 60. Transport 60 advances sheet 150 to sheet transport 48. Sheet 150 is advanced by transport 60 in synchronism with the movement of sheet gripper 84. In this way, the leading edge of sheet 150 arrives at a preselected position, i.e. a loading zone, to be received by the open sheet gripper. The sheet gripper then closes, securing sheet 150 thereto for movement therewith in a recirculating path. The leading edge of sheet 150 is secured releasably by the sheet gripper. As belts 54 move in the direction of arrow 62, the sheet moves into contact with the photoconductive belt, in synchronism with the toner image developed thereon. At transfer zone 64, a corona generating device 66 sprays ions onto the backside of the sheet so as to charge the sheet to the proper electrostatic voltage magnitude and polarity for attracting the toner image from photoconductive belt 20 thereto. The sheet remains secured to the sheet gripper so as to move in a recirculating path for three cycles. In this way, three different color toner images are transferred to the sheet in superimposed registration with one another. One skilled in the art will appreciate that the sheet may move in a recirculating path for four cycles when under color black removal is used and up to eight cycles when the information on two original documents is being merged onto a single copy sheet. Each of the electrostatic latent images recorded on the photoconductive surface is developed with the appropriately colored toner and transferred, in superimposed registration with one another, to the sheet to form the multi-color copy of the colored original document.

After the last transfer operation, the sheet gripper opens and releases the sheet. A conveyor 68 transports the sheet, in the direction of arrow 70, to a fusing station, indicated generally by the reference numeral 71, where the transferred toner image is permanently fused to the sheet. The fusing station includes a heated fuser roll 74 and a pressure roll 72. The sheet passes through the nip defined by fuser roll 74 and pressure roll 72. The toner image contacts fuser roll 74 so as to be affixed to the sheet. Thereafter, the sheet is advanced by a pair of rolls 76 to catch tray 78 for subsequent removal therefrom by the machine operator.

The last processing station in the direction of movement of belt 20, as indicated by arrow 22, is a cleaning station, indicated generally by the reference numeral 79. A rotatably mounted fibrous brush 80 is positioned in the cleaning station and maintained in contact with photoconductive belt 20 to remove residual toner particles remaining after the transfer operation. Thereafter, lamp 82 illuminates photoconductive belt 20 to remove any residual charge remaining thereon prior to the start of the next successive cycle.

Figure 1A:
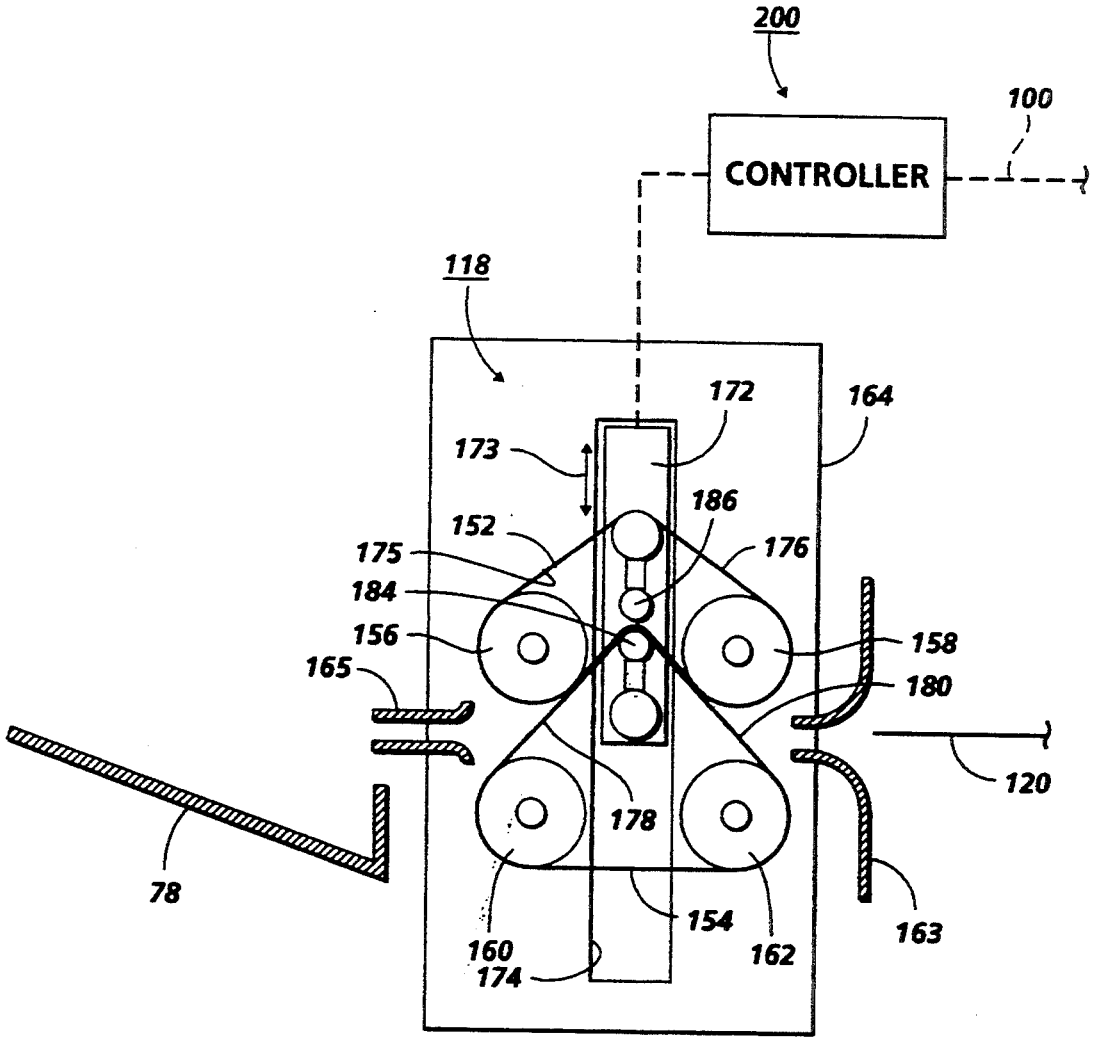
FIGS. 1A–1C are elevational views illustrating various positions of a decurling apparatus incorporating the adaptive system of the present invention.
Figure 1B:
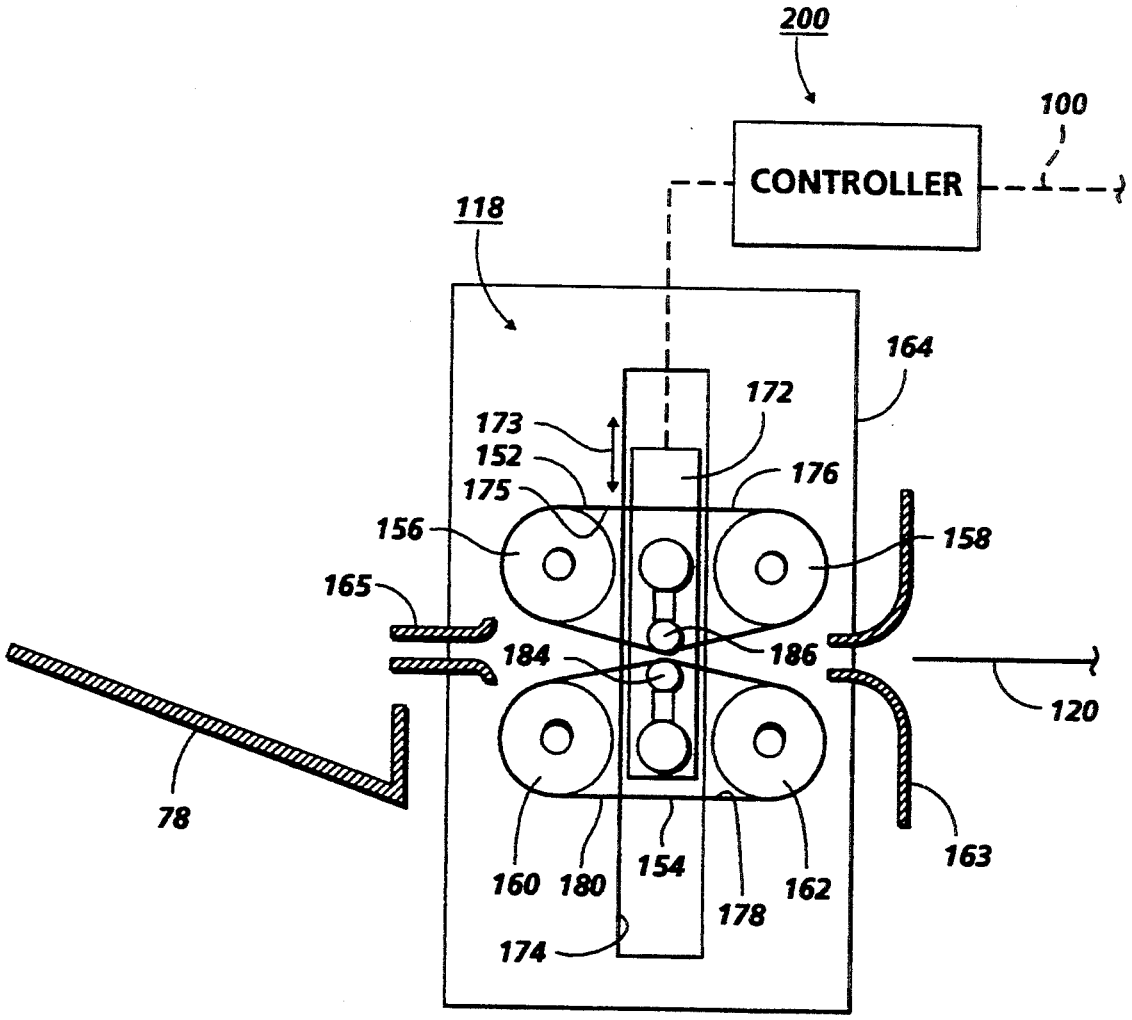
Figure 1C:
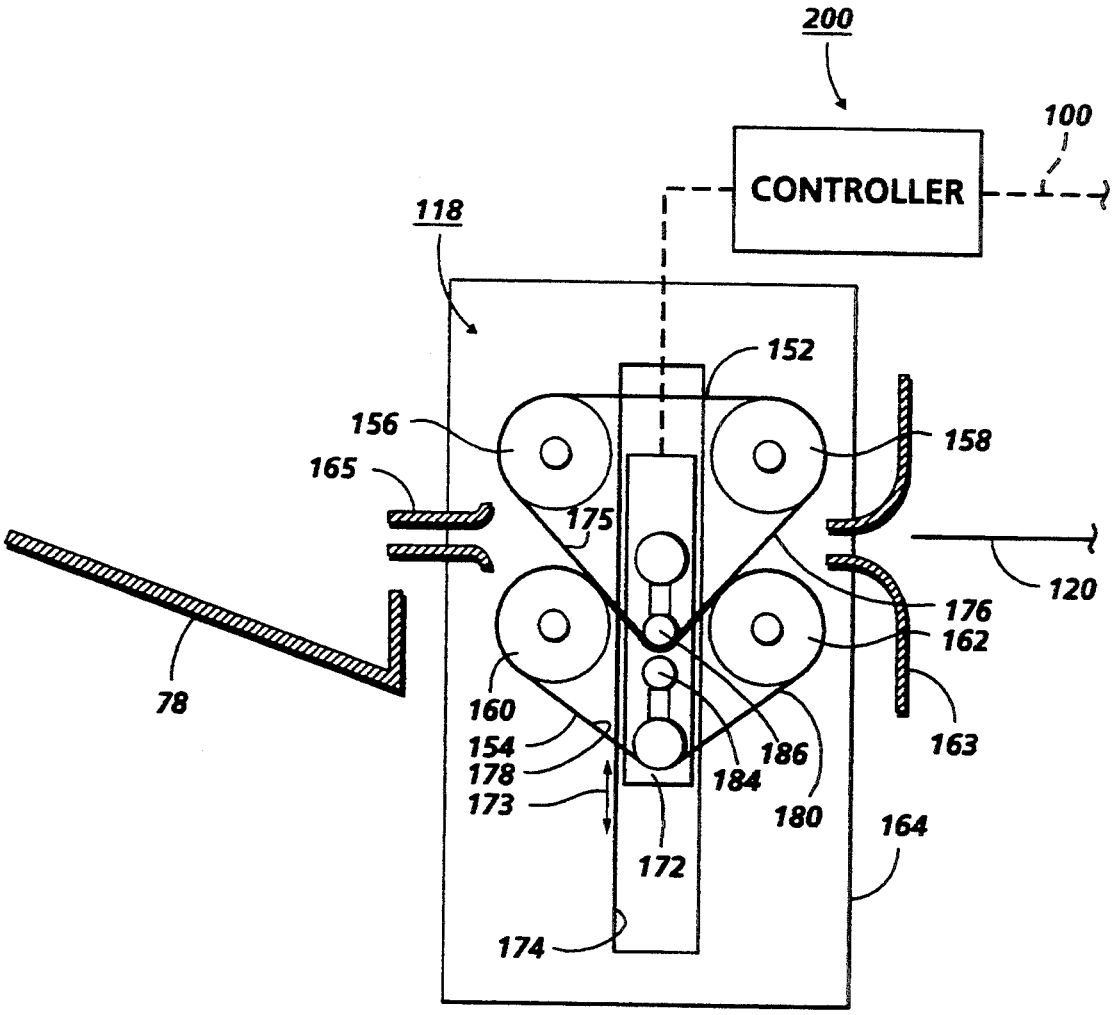

The adaptive decurler apparatus 118 is shown in more detail in FIGS. 1A–1C inclusive. More specifically, the decurler apparatus 118 includes a first set of decurler belts 152 and a second set of decurler belts 154. The first set of decurler belts 152 are entrained about a first belt shaft 156 and a second belt shaft 158. The second set of decutter belts 54 are entrained about a third belt shaft 160 and a fourth belt shaft 162. Belt shafts 156, 158, 160 and 162 are each mounted between a pair of side plates 164. A motor (not shown) is secured adjacent to the sideplate 164 and mechanically coupled to the first belt shaft 156 by a drive belt (not shown). In turn, the first belt shaft 156 is mechanically coupled to the third belt shaft 160 by a set of gears (not shown). As the motor rotates the drive belt, the first belt shaft 156 and consequently the third belt shaft 160 are caused to rotate. As a result, each of the decurler belts 152 and each of the decurler belts 154 are caused to advance in a recirculating path of movement. The decurler apparatus 118 further includes an inlet baffle 163 and an outlet baffle 165.

The decurler belts 152 and 154 are each made from a polyurethane material. As a result, an inner surface portion 174, 178 of each of the decurler belts 152, 154 comprises a polyurethane material. However, molded in an outer surface portion 176, 180 of each of the decurler belts 152, 154 is a dispersion of fine powder material. Preferably, the fine powder material is an ultra high molecular weight polyethylene material. Since the outer surface portion 176, 180 of each of the decurler belts 152, 154 comprises a fine powder material such as an ultra high molecular weight polyethylene material, the frictional resistance between the outer surface portion 176, 180 of each of the decurler belts 152, 154 and the sheet 120 is reduced during advancement of the sheet through the decurler apparatus 118. During advancement of the sheet through the decurler apparatus 118, the sheet is advanced between the outer surface portion 176 of each of the decurler belts 152 and the outer surface portion 180 of each of the decurler belts 154.

The decurler apparatus 118 additionally includes a movable assembly, generally indicated by the reference numeral 172. The movable assembly 172 is slidably mounted between sideplates 164. An elongated slot 174 is defined in each sideplate 164. The movable assembly 172 is selectively positionable in accordance with the present invention at one of a number of positions along the length of the elongated slots as indicated by the two headed arrow 173.

An arcuate portion or region of the first decurler shaft 184 is positionable to contact the inner surface portion 178 of each of the decurler belts 154 while an arcuate portion or region of the second decurler shaft 186 is positionable to contact the inner surface portion 174 of each of the decurler belts 152. In operation, the decurler belts 152 and the decurler belts 154 each travel through the space defined between the first decurler shaft 184 and the second decurler shaft 186 (see FIGS. 1A–1C). Therefore, as the movable assembly 172 is linearly adjusted to one of a variety of positions, as shown in FIGS. 1A–1C, the sheet path through the decurler apparatus 118 is correspondingly adjusted. As a result, a discrete amount of mechanical force may be applied to the sheet within a range of amounts of mechanical force in either the positive or the negative direction as the sheet is advanced through the nip defined by the area of contact between the outer surface portion 176 of each of the decurler belts 152 and the outer surface portion 180 of each of the of decurler belts 154. When the movable assembly 172 is positioned as shown in FIG. 1A, each of the decurler belts 154 are positioned in contact with an arcuate portion of the first decurler shaft 184 while each of the decurler belts 152 are respectively positioned in contact with the decurler belts 154 and are bent around the arcuate portion of the first decurler shaft 184. When the movable assembly 172 is positioned at a neutral decurling position as shown in FIG. 1B, the decurler belts 152 are spaced apart from the decurler belts 154. At this neutral decurling position, only a nominal amount of mechanical force is exerted against the sheet by the decurler apparatus 118. When the movable assembly 172 is positioned as shown in FIG. 1C, each of the decurler belts 152 are positioned in contact with an arcuate portion of the second decurler shaft 186 while each of the decurler belts 154 are respectively positioned in contact with the decurler belts 152 and are bent around the arcuate portion of the second decurler shaft 186.

The printing machine 18 of the present invention includes a control system, which automatically adjusts the movable assembly to a position to remove the predicted amount of curl in response to various input data received by the control system such as the sheet basis weight, the amount of toner on the sheet, the size and orientation of the sheet and the moisture content of the sheet as reflected by a humidity measurement by a sensor or by an analysis of the electrical data generated in the electrostatic transfer zone as discussed below in further detail.

To aid in the guidance of the sheet through the sheet path of the decurler apparatus 118, a strip of flexible material (not shown) may be positioned near the sheet path between each set of neighboring decurler belts 152, and also between each set of neighboring decurler belts 154. Each strip of flexible material would extend from the inlet baffle 163 to the outlet baffle 165 and through the space defined between the first decurler shaft 184 and the second decurler shaft 186.

Discussing further the FIGS. 1A–1C, which illustrate the adaptive decurler system, a sheet 120 is shown entering the decurling nip. A data stream 100 is shown being inputted to controller 200. The data stream 100 is made up of several types of information and will contain image information from the IPS, it will also contain basis weight information from the basis weight detector 140, and will also contain moisture content information from humidity sensor 142. The basis weight detector can be of the type described in U.S. Pat. No. 5,138,178 which utilizes an infrared emitter and a phototransistor receptor to determine the weight of the sheet based on the voltage output variance of the phototransistor as the sheet passes between the emitter and receptor, the relevant portions thereof being hereby incorporated into this application. The humidity sensor can be of the type utilized in the Xerox 5775 digital color copier.

In a light lens type copying machine which does not utilize an IPS, a densitometer or other sensor or array thereof can be utilized to determine image density on a sheet and emit a signal to the controller. Since the image has been developed, the patterns thereof are optically readable by illuminating them with a light emitter and sensing the patterns of reflected light. The sensor then emits a signal indicative of the density of the illuminated pattern. One such example of a densitometer is described in U.S. Pat. No. 5,053,822, the relevant portions thereof being hereby incorporated into this application.

The controller 200 will then predict, based on the data received from the various sensors and the image data information, the degree of decurling required. Certain characteristics such as light weight paper, high area coverage, heavy toner concentrations (dense image data), full color versus black only images, dry or moist paper, whether a sheet is to be printed in a simplex or duplex mode and combinations of the above conditions are known to cause certain types of curl.

Based on the input variables as described below the proper degree and direction of decurling force can then be chosen for each image bearing sheet. The degree of decurling force applied is known as penetration and reflects the angle of the decurling nip in the illustrated embodiment.

Figure 2A:
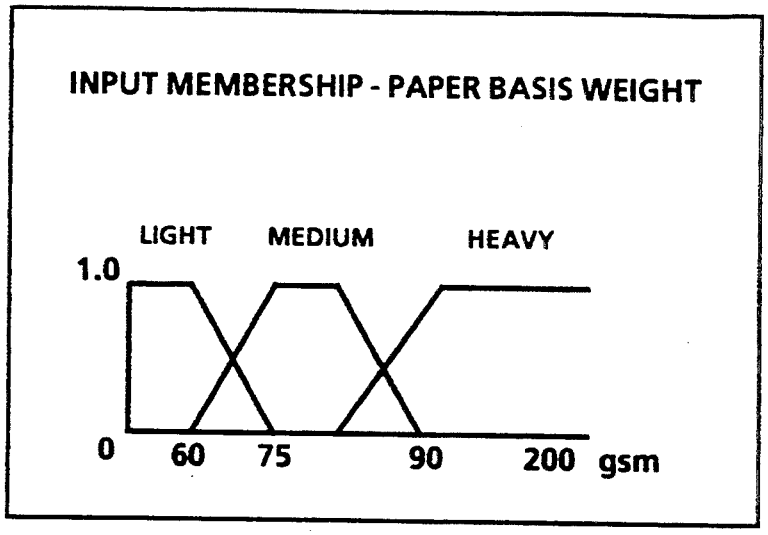
FIGS. 2A, 2B and 2C are graphical representations of the membership functions which articulate the bounds of the input variables for paper weight, environment and image density respectively.
Figure 2B:
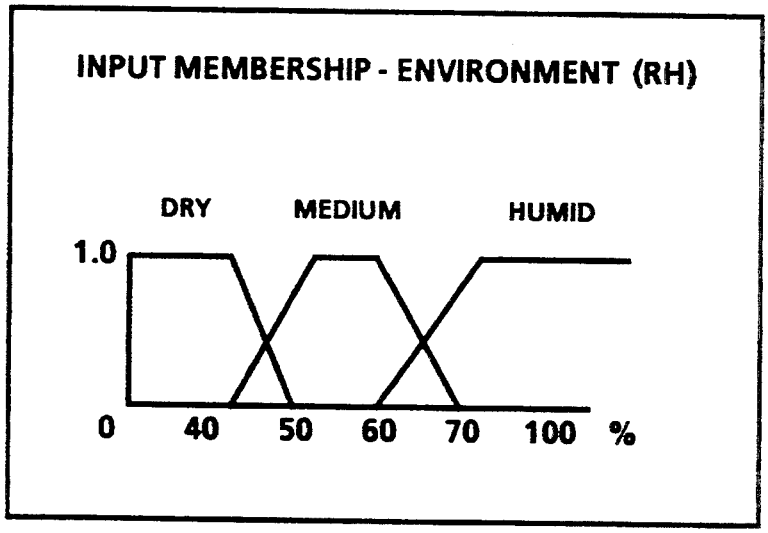
Figure 2C:
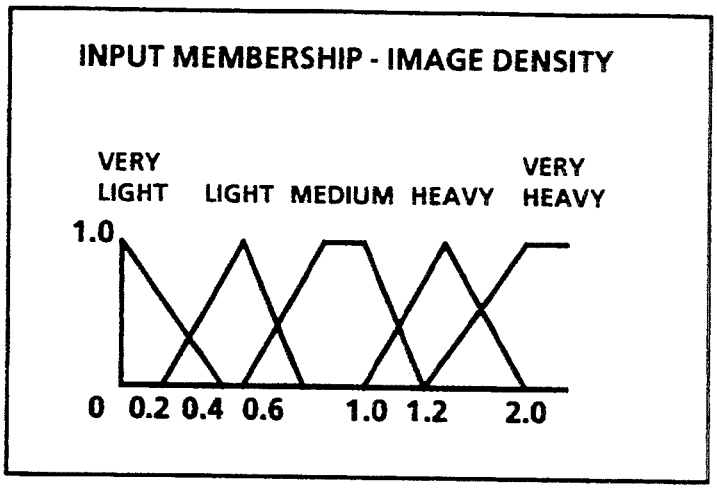

FIGS. 2A, 2B, and 2C illustrate graphically the membership functions for each input variable which mathematically define the linguistic variables used in the control rules. These functions can be used to calculate parameters upon which the degree of penetration will be based. The functions illustrated define the bounds of the variables being measured so as to enable a weighing factor to be attributed to each variable as data is inputted. As an example, looking to FIG. 2A if a sheet were determined to have a weight of 65 grams per square meter it can be seen that this reading would be approximately 70% in the light range and 30% in the medium range. Thus the factor attributable to this weight paper would be a blend of both light and heavy. This weight factor in combination with the other determined variables is used to construct look up tables as is discussed below. This technique for blending variables is known as "fuzzy logic control" or "fuzzy control".

The development of a Fuzzy Logic Controller (FLC) requires three distinct steps:

(1) the fuzzification of input values where specific values of the controller inputs are mapped to the linguistic labels by means of the membership functions (2) a set of fuzzy if-then inferencing rules are developed which define relationship between the inputs and the outputs (3) a defuzzification process which converts the output labels selected by the application of the inputs to the rules back into numerical values.

Below in Table 1 is a example of a lookup table based on the functions illustrated in FIGS. 2A–2C inclusive, for decurling penetration as a function of image density and paper basis weight. The penetration value is given as a high, medium or low penetration value in the direction toward the image (TI), which is generally the direction required for full color images, based on normal environment (for the purposes of this table humidity remains constant at a medium level). For black only images the required decurl direction is normally in the direction away from the image (AI) so a similar table reflecting the same values in the opposite direction can be constructed.

TABLE 1

| Image Density → Paper Basis Weight ↓ | Light | Medium | Heavy |
|---|---|---|---|
| Light | H | M | L |
| Medium | M | M | L |
| Heavy | L | L | L |

This lookup table can be interpreted as a set of fuzzy if-then example, we can read the first entry in table as If the Paper Basis Weight is Light AND the Image Density is Light THEN the Nip Penetration is HIGH.

The output value is converted from a linguistic label to a numerical value by means of defuzzification. This requires that numerical values be assigned to each nominal output label. For example, an output value of high might be assigned a value of 90% (of full scale output), a medium output given 60% and a low output is 30%. This is shown in Table 2.

TABLE 2

| Linguistic Value → | Low | Medium | High |
|---|---|---|---|
| Numerical Equivalent→ | 30% | 60% | 90% |

In our example, the input values for paper basis weight (65 gsm) fell 70% in the light range (which calls for a HIGH output) and 30% fell in the medium range (which calls for a medium output), then if the output depended only on the value of the Basis Weight is computed by simple interpolation to be:

$$0.7\times(90\%)+0.3\times(60\%)=81\% \text{ of Full Scale Output}$$

Similarly, tables can be constructed as a function of image density and environment condition where penetration is given as a value based on medium paper (Table 3) and as a function of paper basis weight and environment condition where penetration is given as a high, low or medium value based on medium image density as shown below in Table 4.

Each of the above tables is variable in two dimensions and is based on three variables with one constant. To perform the decurling strategy, three tables as shown above in Table 1 can be constructed, one each for dry, medium (or normal as shown) and humid environmental conditions. When the moisture content of the paper is determined and the

TABLE 3

| Image Density→ Environment ↓ | Light | Medium | Heavy |
|---|---|---|---|
| Humid | H | M | L |
| Medium | M | M | L |
| Dry | L | L | L |

TABLE 4

| Paper Basis Weight → Environment ↓ | Light | Medium | Heavy |
|---|---|---|---|
| Humid | H | M | L |
| Medium | M | M | L |
| Dry | L | L | L |

proper table is selected, the image density and paper basis weight can then be inputted to the chosen table and the degree of decurling penetration determined. If, for the example discussed above with reference to FIG. 2A, the initial variable is a blend of more than one range as discussed above, a multi-variable controller must be utilized. In the case of a multi-variable controller it becomes necessary to combine multiple rules. This is somewhat more complicated than the simple example given above. Consider the example above, with the addition of an Image Density Input of 1.05. As we can see from FIG. 2C, this results in an Image Density which has about 65% membership in the Normal range and 35% in the Heavy Range.

This then activates 4 rules from the total set since we must relate two values of Paper Basis Weight with two values of Image Density. These four rules are given below.

(1) IF the Paper Basis Weight is Light AND the Image Density is Normal THEN the Output Action is MEDIUM.

(2) IF the Paper Basis Weigh t is Medium AND the Image Density is Heavy THEN the Output Action is LOW.

(3) IF the Paper Basis Weight is Light AND the Image Density is Heavy THEN the Output Action is LOW.

(4) IF the Paper Basis Weight is Medium AND the Image Density is Normal THEN the Output Action is MEDIUM.

Recall that the weights were 70% for light paper and 30% for medium, while the Image Density was split 65–35% between medium and heavy. This gives rise to the following.

| Defuzzification Table | | | |
|---|---|---|---|
| Rule | Paper | Image | Output |
| 1 | 70% | 65%* | MEDIUM |
| 2 | 30%* | 35% | LOW |
| 3 | 70% | 35%* | LOW |
| 4 | 30%* | 65% | MEDIUM |

Notice that the minimum input (antecedent) for each rule has an asterisk next to it. We use the minimum antecedent for each rule and then choose the maximum support level for each output (consequent). So in this example, we support the MEDIUM output at a 65% level from Rule 1, while at the same time we support LOW at the 35% level from Rule 3. We don't use the outputs of Rules 2 and 4 since we already have a consequence of MEDIUM and LOW. Thus using our weighted interpolation as we did in the previous example we get:

$$0.65\times(60\%)+0.35\times(30\%)=49.5\% \text{ of Full Scale Output}$$

Figure 3:
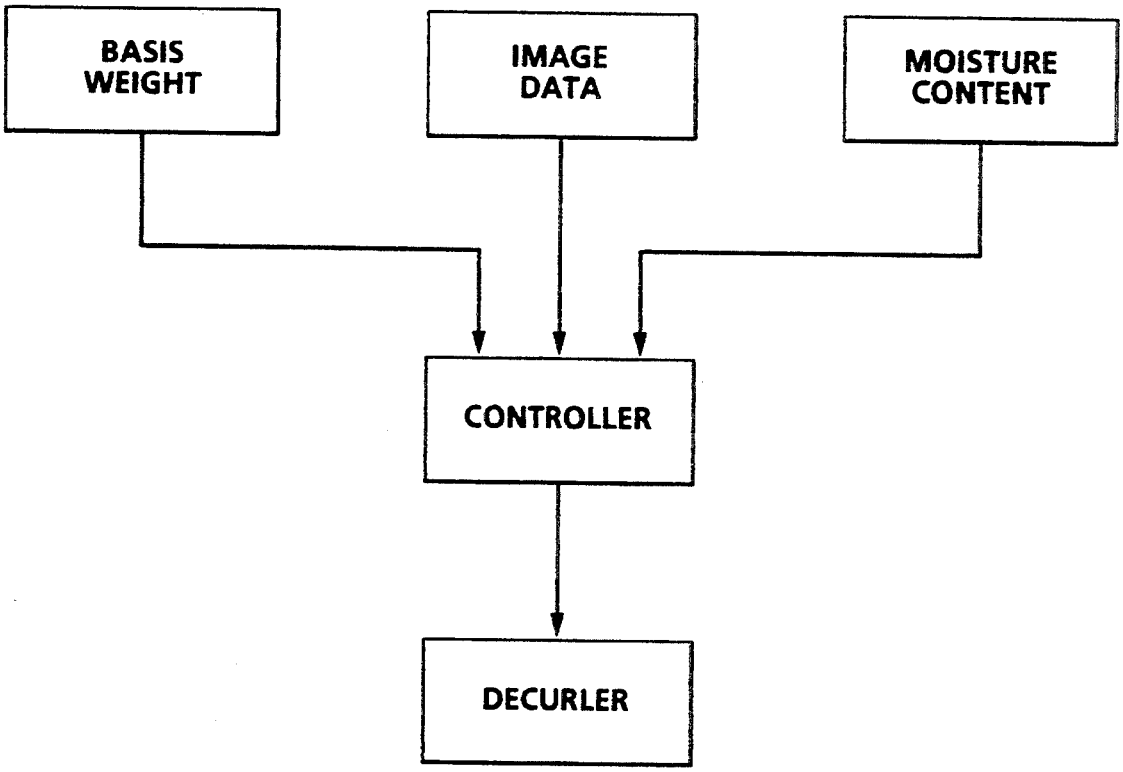
FIG. 3 is a flow diagram illustrating the information flow utilized to perform the decurling scheme of the present invention.

The flow diagram of FIG. 3 illustrates the information flow utilizing the decurling scheme of the present invention.

With a decurler device 118 as shown it is also possible to utilize a continuously variable decurling force as opposed to only three discrete settings of high, medium or low. A set of arbitrary numerical values from 1 to 10 can be assigned to the various decurling positions and a more detailed look up table constructed for each set of variables using the same logic as described above so as to provide more precise decurling. Another approach would be to define output membership functions similar to the ones described for the inputs above, as opposed to the simpler, singleton outputs shown in the example.

In recapitulation, there is provided an apparatus for adaptive sheet decurling in an electrophotographic printing machine. A plurality of sensors are provided to determine the basis weight of the copy sheet, the density of the image being transferred to the copy sheet and fused thereon, the relative humidity of the machine environment, the fusing temperature, the process speed of the print engine, etc. Signals indicative of all the variables are generated and sent to the machine controller which processes these signals and predicts the degree and direction of curl expected in a sheet. Based on the degree of and direction of curl, a bidirectional variable penetration decurler is actuated to a setting which should provide the proper amount of mechanical decurling force.

It is, therefore, apparent that there has been provided in accordance with the present invention, an adaptive sheet decurler that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. A printing machine in which an image is fixed to a sheet, wherein the improvement comprises:

means for determining at least one of a plurality of parameters of the sheet and generating a signal indicative thereof, said determining means comprising means for determining the sheet moisture content and generating a signal indicative thereof;

an adjustable decurling device; and a controller, responsive to the signal from said determining means, for adjusting said decurling device.

2. A printing machine according to claim 1, wherein said determining means further comprises, means for determining the density of the image and generating a signal indicative thereof, said controller being adapted to receive the signal from said density determining means and the signal from said moisture determining means and, in response thereto, adjusting said decurling device.

3. A printing machine in which an image is fixed to a sheet, wherein the improvement comprises:

means for determining at least one of a plurality of parameters of the sheet and generating a signal indicative thereof, said determining means further comprising, means for determining the density of the image and generating a signal indicative thereof and means for determining the basis weight of a sheet and generating a signal indicative thereof;

an adjustable decurling device; and a controller, responsive to the signal from said determining means, for adjusting said decurling device, said determining means further comprising, means for determining the moisture content of the sheet and generating a signal indicative thereof, said controller being adapted to receive the signal from said moisture determining means, the signal from said density determining means and the signal from said basis weight determining means and, in response thereto, adjusting said decurling device.

4. A printing machine in which an image is fixed to a sheet, wherein the improvement comprises:

means for determining at least one of a plurality of parameters of the sheet and generating a signal indicative thereof, said determining means comprising means for determining the basis weight of a sheet and generating a signal indicative thereof;

an adjustable decurling device; and a controller, responsive to the signal from said determining means, for adjusting said decurling device, said determining means further comprising, means for determining the moisture content of the sheet and generating a signal indicative thereof, said controller being adapted to receive the signal from said moisture determining means and the signal from said basis weight determining means and, in response thereto, adjusting said decurling device.

5. A method for predicting the amount of curl in a sheet and applying a variable decurling force in a printing machine comprising the steps of:

determining at least one of a plurality of parameters effecting decurling a sheet and generating a signal indicative thereof, said determining step comprising determining the moisture content of the sheet and generating a signal indicative thereof; and adjusting, in response to the signal, the decurling force being applied to the sheet by a sheet decurler.

6. A method according to claim 5, wherein said determining step further comprises, determining density of an image and generating a signal indicative thereof, said adjusting step receiving the image density signal and the moisture signal to adjust the decurling force being applied to the sheet by the sheet decurler.

7. A method for predicting the amount of curl in a sheet and applying a variable decurling force in a printing machine comprising the steps of:

determining at least one of a plurality of effecting decurling a sheet and generating a signal indicative thereof, said determining step comprising determining the basis weight of the sheet and generating a signal indicative thereof, determining the density of an image and generating a signal indicative thereof, and determining the moisture content of the sheet and generating a signal indicative thereof; and adjusting, in response to the signal, the decurling force being applied to the sheet by a sheet decurler, said adjusting step receiving said moisture content signal, said image density signal and said basis weight signal to adjust the decurling force being applied to the sheet by the sheet decurler.

8. A method for predicting the amount of curl in a sheet and applying a variable decurling force in a printing machine comprising the steps of:

determining at least one of a plurality of parameters effecting decurling a sheet and generating a signal indicative thereof, said determining step comprising, determining the basis weight of the sheet and generating a signal indicative thereof and determining the moisture content of the sheet and generating a signal indicative thereof; and adjusting, in response to the signal, the decurling force being applied to the sheet by a sheet decurler, said adjusting step receiving said moisture content signal and said basis weight signal to adjust the decurling force being applied to the sheet by the sheet decurler.

9. A method for predicting the amount of curl in a sheet and applying a variable decurling force in a printing machine comprising the steps of:

determining at least one of a plurality of parameters effecting decurling a sheet and generating a parameter signal indicative thereof; and adjusting, in response to the parameter signal, the decurling force being applied to the sheet by a sheet decurler, said adjusting step comprising a technique for blending variables known as "fuzzy logic control".

* * * * *